US010751232B1

(12) United States Patent
Ilao

(10) Patent No.: US 10,751,232 B1
(45) Date of Patent: Aug. 25, 2020

(54) MOBILE APPLICATION-CONTROLLED UNDERCARRIAGE

(71) Applicant: Erwin Roldan Ilao, Daly City, CA (US)

(72) Inventor: Erwin Roldan Ilao, Daly City, CA (US)

(73) Assignee: Erwin Ilao CA (US)

( * ) Notice: Subject to any disclaimer, the term of this patent is extended or adjusted under 35 U.S.C. 154(b) by 136 days.

(21) Appl. No.: 15/984,173

(22) Filed: May 18, 2018

(51) Int. Cl.
*A61G 5/04* (2013.01)
*A61G 5/10* (2006.01)

(52) U.S. Cl.
CPC ..... *A61G 5/047* (2013.01); *A61G 5/1051* (2016.11); *A61G 2203/10* (2013.01); *A61G 2203/76* (2013.01)

(58) Field of Classification Search
CPC ..... A61G 5/047; A61G 5/04
See application file for complete search history.

(56) References Cited

U.S. PATENT DOCUMENTS 4,386,672 A * 6/1983 Coker ..... A61G 5/047 180/13
4,503,925 A * 3/1985 Palmer ..... A61G 5/047 180/13
5,016,720 A * 5/1991 Coker ..... A61G 5/047 180/13
5,050,695 A * 9/1991 Kleinwolterink, Jr. ..... A61G 5/047 180/13
5,826,670 A * 10/1998 Nan ..... A61G 5/047 180/15
6,766,871 B2 * 7/2004 Sawyer ..... A61G 5/047 180/13
7,117,967 B2 * 10/2006 Kidd ..... A61G 5/047 180/209
7,174,093 B2 * 2/2007 Kidd ..... A61G 5/047 180/58
7,306,250 B1 * 12/2007 Mills ..... A61G 5/047 180/11
7,694,991 B2 * 4/2010 Mills ..... A61G 5/1051 180/11
8,127,870 B2 * 3/2012 March ..... A61G 5/02 180/19.1

(Continued)

*Primary Examiner* — Joseph M Rocca
*Assistant Examiner* — Michael R Stabley
(74) *Attorney, Agent, or Firm* — Plager Schack LLP; Mark H. Plager; Alexis J. Saenz

(57) ABSTRACT

An undercarriage system couples to other vehicles, such as wheelchairs and provides mobile application-driven operation. In an exemplary application, the system may be configured to receive a push driven wheelchair and temporarily retrofit the wheelchair for motorized operation. The system includes a console for a mobile computing device that operates a software application and user interface that steers the undercarriage system for navigating through an area such as an airport or other complex. In some embodiments, the software application may provide automated navigation of the undercarriage system so that, for example, the user only needs to enter in a destination (for example, a terminal number) and the application automatically drives the system including the wheelchair to the destination. Sensors and/or cameras may detect objects or markers to guide the steering.

5 Claims, 4 Drawing Sheets

(56) References Cited

U.S. PATENT DOCUMENTS

| | | | | |
|---|---|---|---|---|
| 8,280,561 | B2 * | 10/2012 | Griggs | G05G 9/047 180/19.3 |
| 8,430,189 | B2 * | 4/2013 | Tallino | A61G 5/047 180/11 |
| 8,960,340 | B2 * | 2/2015 | Tallino | A61G 5/047 180/11 |
| 9,669,857 | B1 * | 6/2017 | Rainey | B62B 5/0026 |
| 9,701,329 | B2 * | 7/2017 | Johnson | B62B 3/008 |
| 9,757,290 | B1 * | 9/2017 | Scognamiglio | A61G 5/10 |
| 2007/0289787 | A1 * | 12/2007 | Wiff | A61G 5/047 180/16 |
| 2008/0223649 | A1 * | 9/2008 | Wandeler | A61G 3/065 180/333 |
| 2011/0271782 | A1 * | 11/2011 | Perk | A61G 5/047 74/484 R |
| 2018/0028378 | A1 * | 2/2018 | Behm | A61G 5/042 |
| 2018/0224853 | A1 * | 8/2018 | Izhikevich | G01C 21/005 |

* cited by examiner

MOBILE APPLICATION-CONTROLLED UNDERCARRIAGE

CROSS-REFERENCE TO RELATED APPLICATIONS

None.

BACKGROUND

The embodiments herein relate generally to carriage systems, and more particularly, to a mobile application-controlled undercarriage.

Currently non-motorized vehicles are generally manually pushed and have no features to help automatically steer them to a destination. Wheelchair-bound passengers rely on airlines' contracted staff or employees to push them and their wheelchairs to their gates prior to boarding the plane. Due to shortage in staffing, some customers need to wait for an available person to do this service for them. In some cases, wheelchair-bound customers are forced to seek for a companion to travel by air just because they need someone to push their wheelchair for them. This restricts their freedom and sense of independence. As the population matures and baby boomers retire, airlines will see more and more people travelling on wheelchairs and needing assistance in order to get to their gates. This will increase their labor costs while decreasing their effectiveness in meeting the demand for wheelchair pushers. Some locations, such as airports offer motorized wheel carts for moving luggage around but not for moving people around. Some locations provide an automated wheelchair itself but that leaves the wheelchair owner in a quandary as to what to do with their own wheelchair.

As can be seen, there is a need in large areas such as airports, to provide a system that motorizes manually pushed vehicles so that users can keep their personal vehicle yet still travel more quickly to a destination.

SUMMARY

According to one embodiment of the subject technology, a mobile-application controlled undercarriage system for attachment to a wheelchair comprises a vertical frame including a forward side, a rear side, a top end, and a bottom end; a horizontal frame coupled to the bottom end of the vertical frame and projecting out from the rear side of the vertical frame; a pivot joint on the top end of the vertical frame; a rotatable cross-bar on the top end of the vertical frame, configured to rotate from the rear side of the vertical frame over the top end of the vertical frame and to the front side of the vertical frame, about the pivot joint; a receptacle in the vertical frame or horizontal frame configured to receive a part of a wheelchair; a console seat attached to the rotatable cross-bar for holding an electronic computing device; a wheel coupled to either the vertical frame bottom end or to the horizontal frame; and a motor coupled to the wheel.

According to another embodiment, a mobile-application controlled undercarriage system for attachment to a wheelchair comprises a vertical frame including a forward side, a rear side, a top end, and a bottom end; a horizontal frame coupled to the bottom end of the vertical frame and projecting out from the rear side of the vertical frame; a steering column on the top end of the vertical frame; a console seat attached to the steering column, for holding an electronic computing device; a wheel coupled to either the vertical frame bottom end or to the horizontal frame; and a motor coupled to the wheel.

BRIEF DESCRIPTION OF THE FIGURES

The detailed description of some embodiments of the present invention is made below with reference to the accompanying figures, wherein like numerals represent corresponding parts of the figures.

DETAILED DESCRIPTION OF CERTAIN EMBODIMENTS

Figure 1:
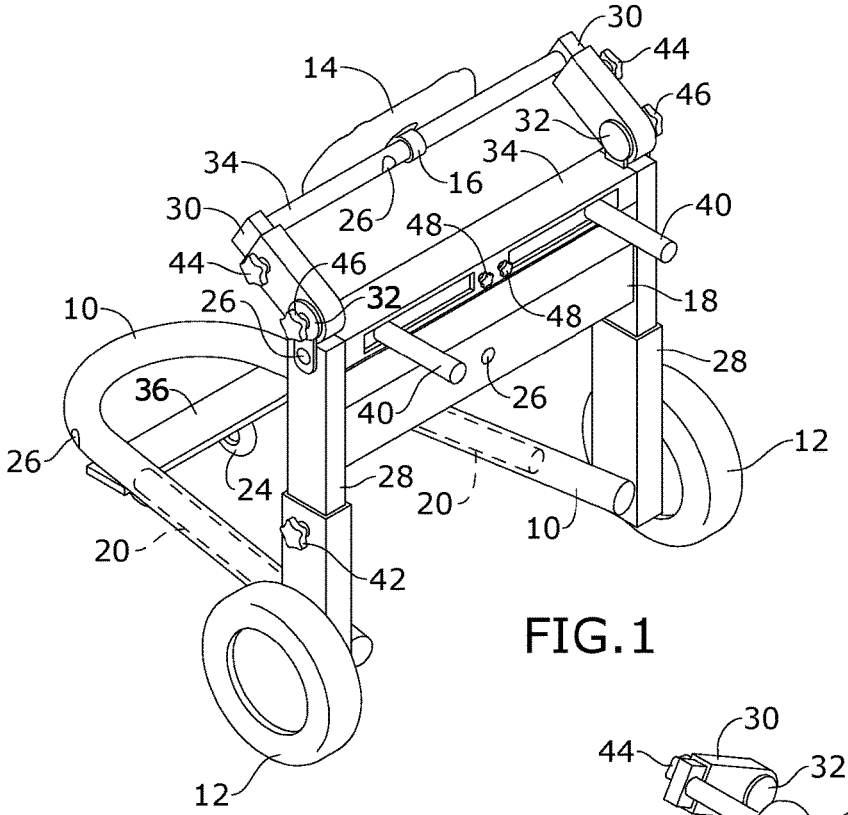
FIG. 1 is a top, front perspective view of an undercarriage system in accordance with an exemplary embodiment of the subject technology.
Figure 2:
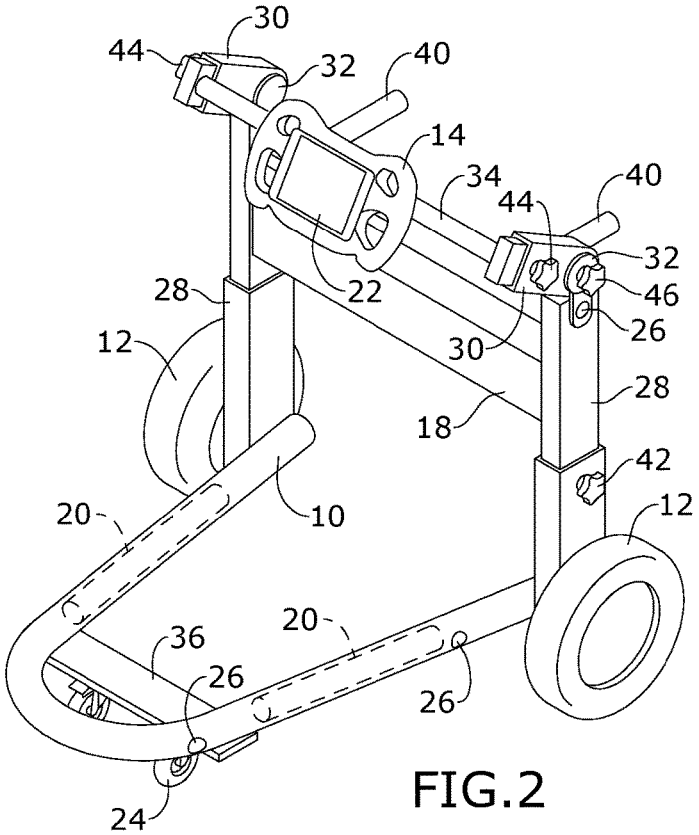
FIG. 2 is a rear, side perspective view of the undercarriage system of FIG. 1.
Figure 3:
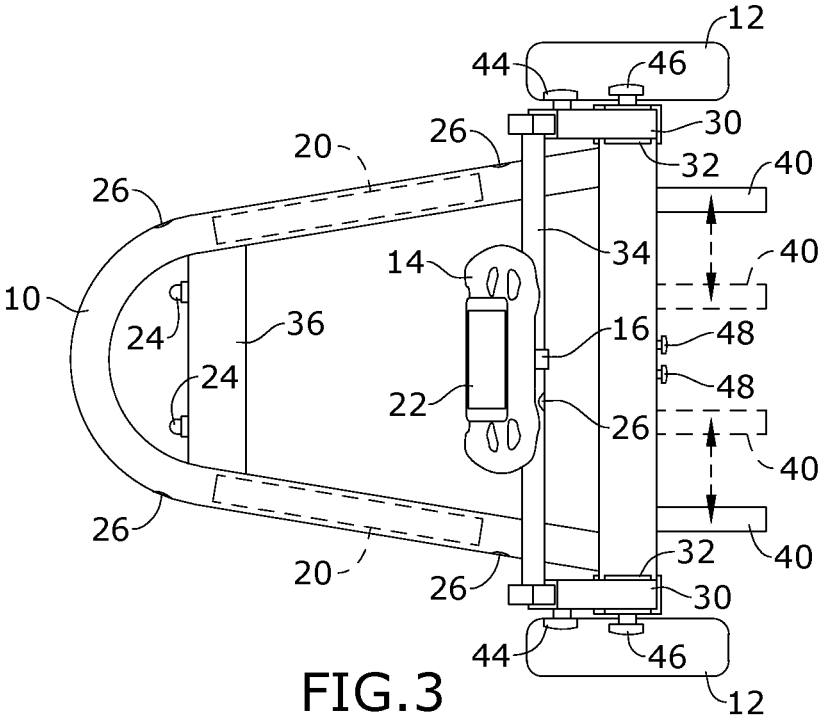
FIG. 3 is a top view of the undercarriage system of FIG. 1.

The word "exemplary" is used herein to mean "serving as an example or illustration." Any aspect or design described herein as "exemplary" is not necessarily to be construed as preferred or advantageous over other aspects or designs.

In general, exemplary embodiments provide an undercarriage system that couples to other vehicles, which when coupled provides mobile application-driven operation. In an exemplary application, aspects of the disclosed system may be configured to receive a push driven wheelchair and temporarily retrofit the wheelchair for motorized operation. Some embodiments may include a software application and user interface which can be loaded into a mobile computing device inserted into or integrated with the undercarriage system so that the user may be provided with a steering system for navigating through an area such as an airport or other complex. In some embodiments, the software application may provide automated navigation of the undercarriage system so that, for example, the user only needs to enter in a destination (for example, a terminal number) and the application automatically drives the system including the wheelchair to the destination.

Referring now to FIGS. 1-5, an undercarriage system is shown according to an exemplary embodiment. The undercarriage system may be configured to receive a vehicle 50 (for example, a wheelchair), to augment the vehicle 50 with electronic steering. In general, the undercarriage system includes a frame 10 (which may comprise a vertical frame and a horizontal frame attached to a bottom end of the vertical frame and projecting rearward from the vertical frame). Motor driven wheels 12 may be attached to the frame 10, which when driven, propel the undercarriage system as controlled by a processing unit 66 (FIG. 7) described in detail below. For sake of illustration, elements of the steering system are omitted such as gears and linkages, which will operate as understood by one of ordinary skill in the art.

The horizontal portion of the frame 10 may include a U-shaped bar projecting rearward from the rear side of the vertical frame. Some embodiments may include smart casters 24 attached to a beam 36 that spans across an opening of the U-shaped bar. Some embodiments may include rechargeable batteries 20 embedded within the U-Shaped bar.

The vertical portion of the frame may include columns 28 that telescope from a base portion of the vertical frame and secured into position by locking knobs 42. As will be appreciated, elements related to the height of the vertical frame may be adjusted to accommodate positioning of undercarriage system elements to the user and his/her vehicle 50. One or more receptacles 40 may be coupled to the vertical frame and positioned to receive a part of the vehicle 50. For example, the receptacles 40 may be sleeves or another open-ended element that may be positioned to receive within their interior, the rearward projecting handles 52 of a wheelchair. In some embodiments, the receptacles 40 may slide toward or away from each other and may be adjusted and locked into place by knobs 48. The combination of the vertical adjustment of the frame and the horizontal adjustable positioning of the receptacles 40 provides flexibility in receiving vehicles 50 of varying design.

In an exemplary embodiment, the vertical frame includes a steering column system. The steering column system may include a seat console 14 which may include an electronic computing device 22. The electronic computing device 22 may be removable (for example, a user's mobile smartphone or tablet computer) or may be integrated into the seat console 14. In some embodiments, the seat console 14 may be configured to resemble a steering yoke and may mimic operation of a steering wheel when the software application is operating. The seat console 14 may be mounted to a cross-bar 34 (via a steering wheel bearing mount 16) on the top end of the vertical frame. The cross-bar 34 may be attached to a pivot 32 on posts 30. The posts 30 may telescope from a base by operation of length adjustment knobs 44.

Figure 4:
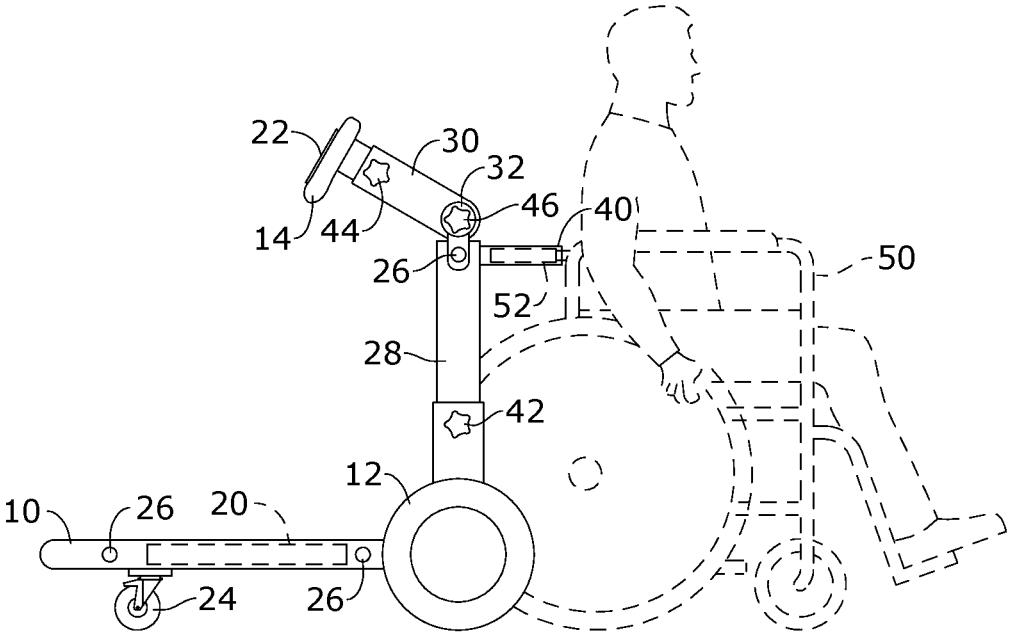
FIG. 4 is a side view of the undercarriage system of FIG. 1 including a wheelchair coupled to the system and a user in the wheelchair according to an embodiment.
Figure 5:
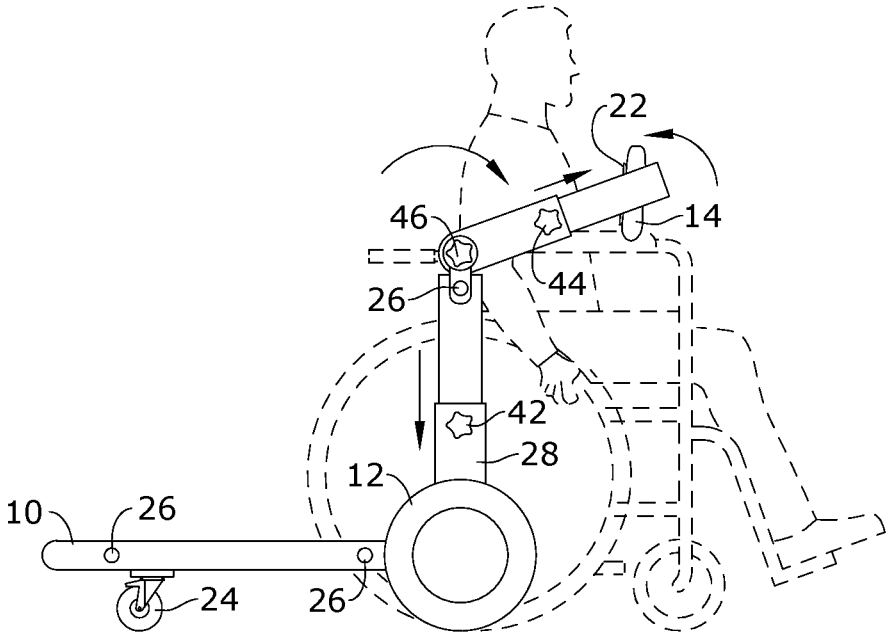
FIG. 5 is a side view of the undercarriage system of FIG. 4 with a rotatable cross-bar moved into an operating position for the user.

Referring to FIGS. 4 and 5, in an exemplary embodiment, the cross-bar 34 may be rotatable about the pivots 32 by unlocking and locking rotating angle adjustment knobs 46 into place so that the cross-bar may be movable from the rear side of the vertical frame (FIG. 4), over the top of the vertical frame and into position projecting from the front side of the vertical frame (FIG. 5), wherein a user is secured into place within their vehicle 50 while joined to the undercarriage system.

Figure 6:
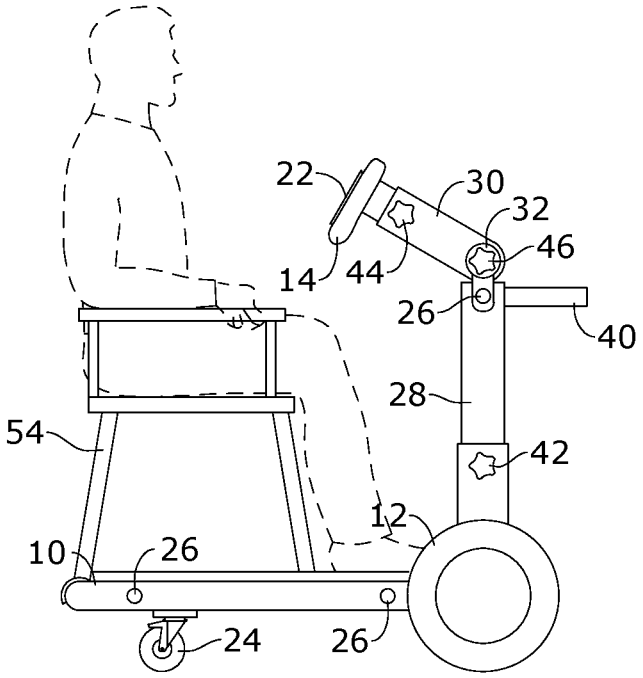
FIG. 6 is a side view of an undercarriage system including a platform on a horizontal frame for carrying a chair and user according to another embodiment.

Referring temporarily to FIG. 6, an alternate embodiment of the undercarriage system is shown. The undercarriage system shown in FIG. 6 is similar to the system shown in FIGS. 1-5 except that it may include a solid platform on the horizontal frame to stably hold a chair 54 onto which a user may sit when operating the undercarriage system to move.

Figure 7:
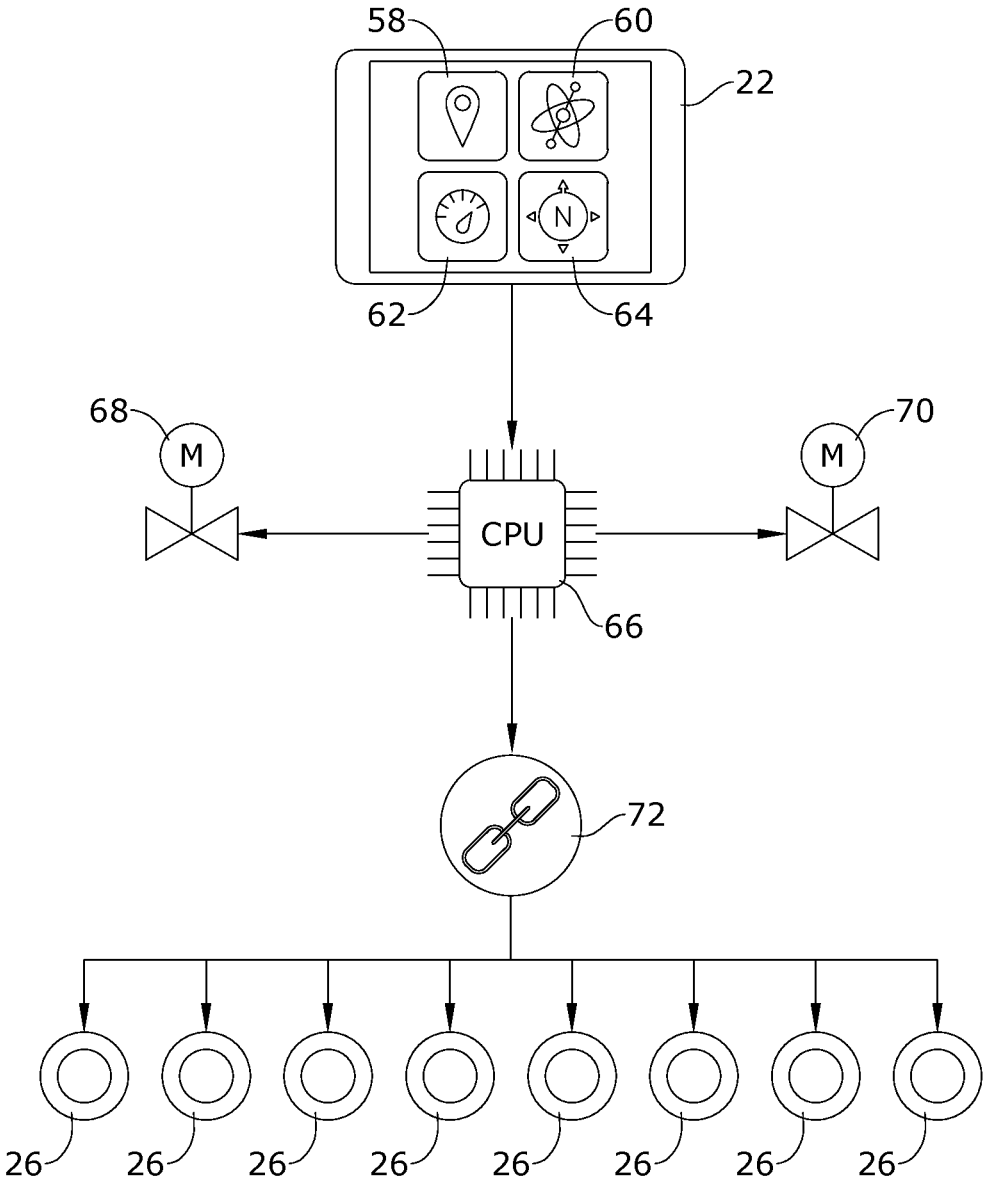
FIG. 7 is a block diagram showing electrical components of the undercarriage system, including connection to an electronic computing device in accordance with another exemplary embodiment of the subject technology.

Referring back now to FIGS. 1-5 but now in conjunction with FIG. 7, detail of the drive operation of embodiments will be discussed. As mentioned previously, the undercarriage system may include a mobile software application to drive the system. The mobile software application may, through the electronic computing device 22 control steering and movement of the wheels 12. The wheels 12 may include motor actuators 68 and 70 to help turn the undercarriage system as needed.

In some embodiments, the electronic computing device 22 is wirelessly linked (via data links 72) to a processing unit 66 in a computer module with a circuitry box 18 of the frame 10. Power may be pulled from the rechargeable batteries 20 into the circuitry box 18 through internal wiring/busses (not shown). The processing unit 66 may also be wirelessly linked to the motor actuators 68 and 70. In some embodiments, the electronic computing device 22 includes steering detectors (for example, a GPS system 58, a gyroscope 60, an accelerometer 62, and a magnetometer 64), which may be read by the processing unit 66 to control steering of the actuators 68 and 70. For example, when the electronic computing device 22 is in the seat console 14, the software application is running, and the user interface is displayed, physical rotation of the seat console 14 may be detected by the steering detectors. The processing unit 66 may register the change in seat console position and translate the change in position as a command to steer the actuators 68 and 70 accordingly. In addition, some embodiments may include an automated steering function in the software application so that entry of a destination in the UI will cause the processing unit to control the actuators 68 and 70 to move the undercarriage system to the destination. As shown throughout FIGS. 1-5 and 7, an embodiment may include sensors 26 in different locations of the frame 10. Through data links 72, the sensors may detect objects which feedback may be provided to avoid collisions or track a pre-defined path in memory. In some embodiments, the sensors 26 may include a camera(s) which can be used to help steer the undercarriage system around objects or to detect through for example, image analysis, markers along a path to the entered destination.

As will be appreciated by one skilled in the art, aspects of the disclosed invention may be embodied as a system, method or process, or computer program product. Accordingly, aspects of the disclosed invention may take the form of an entirely hardware embodiment, an entirely software embodiment (including firmware, resident software, microcode, etc.) or an embodiment combining software and hardware aspects that may all generally be referred to herein as a "circuit," "module," or "system." Furthermore, aspects of the disclosed invention may take the form of a computer program product embodied in one or more computer readable media having computer readable program code embodied thereon.

Any combination of one or more computer readable media may be utilized. In the context of this disclosure, a computer readable storage medium may be any tangible or non-transitory medium that can contain or store a program) for use by or in connection with an instruction execution system, apparatus, or device. A computer readable storage medium may be, for example, but not limited to, an electronic, magnetic, optical, electromagnetic, infrared, or semiconductor system, apparatus, or device, or any suitable combination of the foregoing.

Aspects of the disclosed invention are described below with reference to block diagrams of methods, apparatus (systems) and computer program products according to embodiments of the invention. It will be understood that each block of the block diagrams, and combinations of blocks in the flowchart illustrations and/or block diagrams, can be implemented by computer program instructions. These computer program instructions may be provided to the processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

Persons of ordinary skill in the art may appreciate that numerous design configurations may be possible to enjoy the functional benefits of the inventive systems. Thus, given the wide variety of configurations and arrangements of embodiments of the present invention the scope of the present invention is reflected by the breadth of the claims below rather than narrowed by the embodiments described above.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

What is claimed is:

1. A mobile-application controlled undercarriage system for attachment to a wheelchair, comprising:

a vertical frame including a forward side, a rear side, a top end, and a bottom end;

a horizontal frame coupled to the bottom end of the vertical frame and projecting out from the rear side of the vertical frame;

a pivot joint on the top end of the vertical frame;

a rotatable cross-bar on the top end of the vertical frame, configured to rotate from the rear side of the vertical frame over the top end of the vertical frame and to the front side of the vertical frame, about the pivot joint;

a receptacle in the vertical frame or horizontal frame configured to receive a part of a wheelchair;

a console seat attached to the rotatable cross-bar for holding an electronic computing device;

a wheel coupled to either the vertical frame bottom end or to the horizontal frame; and a motor coupled to the wheel.

2. The undercarriage system of claim 1, further comprising a software application loaded into the electronic computing device, the software application configured to control operation of the motor to drive the wheel and steer the undercarriage system through an airport.

3. The undercarriage system of claim 2, wherein the console seat is configured to rotate and mimic a steering wheel during operation of the motor.

4. The undercarriage system of claim 1, wherein the electronic computing device is integrated into the console seat.

5. The undercarriage system of claim 1, wherein the receptacle is configured to receive a handle projecting rearward from the wheelchair.

* * * * *